United States Patent [19]

Milawski

[11] Patent Number: 4,625,526

[45] Date of Patent: Dec. 2, 1986

[54] NIPPLE DECORATION DEVICE

[76] Inventor: Dale Milawski, 520 Spring Hill Dr., Roselle, Ill. 60172

[21] Appl. No.: 683,049

[22] Filed: Dec. 18, 1984

[51] Int. Cl.[4] ..... A44C 25/00

[52] U.S. Cl. ..... 63/2; 24/523; 63/14 B; 63/14 F; 63/14 G; D11/42

[58] Field of Search ..... 63/14 R, 14 A, 14 B, 63/14 C, 14 D, 14 E, 14 F, 14 G, 31, 2; 428/33, 99, 101; D11/42; 24/239, 522, 523, 526, 545, 546, 566, 11 S, 524

[56] References Cited

U.S. PATENT DOCUMENTS

| | | | |
|---|---|---|---|
| 883,375 | 3/1908 | Anello | 24/523 |
| 1,195,324 | 8/1916 | Allen | 63/14 B |
| 1,208,663 | 12/1916 | Rueckert | 63/14 B X |
| 2,482,625 | 9/1949 | Kunkel | 24/523 |
| 2,510,511 | 6/1950 | Mittendorf | D11/42 X |
| 2,556,654 | 6/1951 | Kulak | 63/14 F |
| 2,669,102 | 2/1954 | Ronstadt | 63/14 G |
| 4,187,838 | 12/1980 | Dubrowski | 63/14 G |

FOREIGN PATENT DOCUMENTS

| | | | |
|---|---|---|---|
| 949296 | 8/1949 | France | 63/14 F |
| 347993 | 7/1960 | Switzerland | 63/14 F |
| 17876 | of 1905 | United Kingdom | 63/14 G |
| 21841 | of 1908 | United Kingdom | 63/14 F |
| 899819 | 6/1962 | United Kingdom | 63/14 G |

*Primary Examiner*—F. Barry Shay
*Attorney, Agent, or Firm*—Alan R. Thiele

[57] ABSTRACT

A nipple decoration device particularly for attachment to a female breast has an integral spring bias which provides a compressive force on two support arms. At the end of each support arm is an arcuate pad which is in contact with the nipple. The nipple decoration device is held in place by the bias force of the integral spring transmitted to the arcuate pads by the support arms.

13 Claims, 7 Drawing Figures

NIPPLE DECORATION DEVICE

BACKGROUND

Field Of The Invention

The present invention relates to jewelry. More specifically the device of the present invention relates to a nipple decoration device.

Devices of all sorts have been attached to the human body for the purpose of making the body more attractive. Most familiar are earrings which are typically worn on the ear lobe. Earrings are held in place either by frictional contact or by piercing of the ear lobe.

It has also become a custom for females to attach earring-like devices to their nipples. As earrings which are normally held in place by friction are not adaptable to being worn on a nipple it has become a practice for those wearing nipple jewelry to pierce their nipple in order to hold these decorative devices in place.

The piercing of the nipple has several complications. First of all it may be painful to pierce a nipple in order to hold a decorative device in place and secondly the wearer may not wish to wear a decorative device at all times. In a pierced nipple it would be necessary to wear a decorative device at all times to maintain the pierced opening within the nipple.

There is therefore a need to provide a device which may be worn to decorate a nipple but may be readily removed and reattached. There is also a need to provide a device does not have to be worn permanently or require piercing of the nipple.

It is an object of the device of the present invention to provide a nipple decoration device which can be comfortably worn and easily detached or removed from the nipple. It is also an object of the device of the present invention to provide a nipple decoration device which may be worn at certain times and then removed and replaced at the wearer's desire. It is yet a further object of the device of the present invention to provide a nipple decoration device that can be worn without piercing the nipple.

SUMMARY OF THE INVENTION

A nipple decoration device and a system for attaching the nipple decoration device to the nipple at the end of a female breast has a spring bias contained within or integral with a C-shaped member. A pair of support arms in contact with the ends of the spring bias are partially contained within or formed as an integral part of a C-shaped member. The ends of the support arms are biased toward the nipple by the spring bias. Arcuate pads are attached to the ends of the support arms to transmit the force from the spring bias to the sides of the nipple and hold the decoration device in place.

When it is desired to wear the nipple decoration device, the arcuate pads are spread apart then placed on either side of the nipple. When the arcuate pads are released the bias force of the spring bias is transmitted by the support arms to the arcuate pads which are in contact with the nipple. The frictional contact of the arcuate pads with either side of the nipple retains the nipple decoration device in place.

BRIEF DESCRIPTION OF THE DRAWINGS

A further understanding of the nipple decoration device and system of the present invention will be had by reference to the accompanying drawings in which.

DESCRIPTION OF THE EMBODIMENTS

Figure 3:
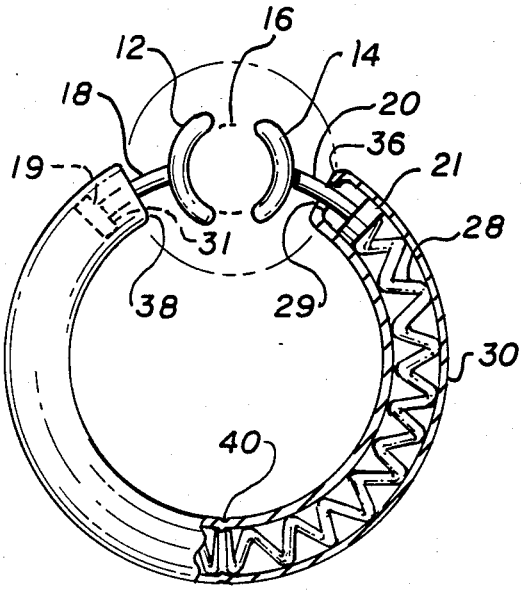
FIG. 3 is a view in front elevation and in partial section of the device shown in FIG. 1.

The present invention will better understood by the following detailed description in which FIGS. 1 through 4 illustrate nipple decoration device 10 in operative association with a female breast 44 (shown in phantom). As may be seen in FIGS. 1 and 2 arcuate pads 12 and 14 engage either side of nipple 16. Arcuate pads 12 and 14 are held in place by support arms 18 and 20. As is best shown in the enlarged view of FIG. 4, the other side being identical, support arm 20 is attached to arcuate pad 14 by being molded or formed thereon. Assisting in the retention of arcuate pad 14 on support arm 20 is enlarged head portion 22 which is an integral part of support arm 20 formed within arcuate pad 14. Should it be desired to use a metal arcuate pad the support arm and arcuate pad may be formed as a single unit as shown in FIG. 3. Alternatively, the arcuate pads 12 and 14 may be welded or glued to support arms 18 and 20.

Figure 4:
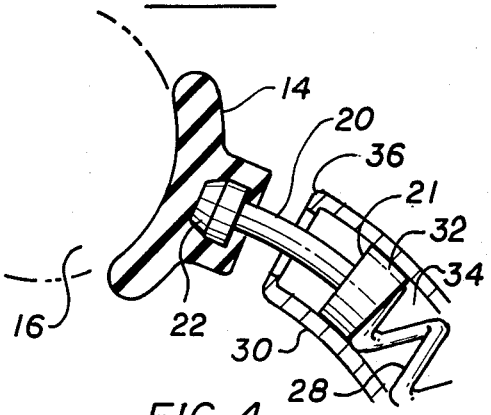
FIG. 4 is an enlarged sectional view of the device shown in FIG. 1.
Figure 5:
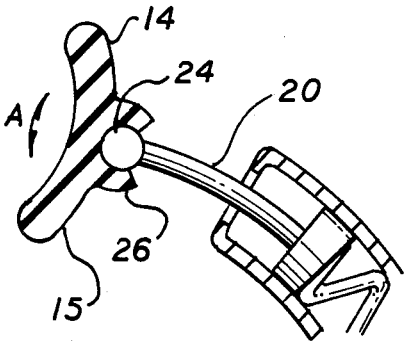
FIG. 5 is an enlarged sectional view of an alternate embodiment of the nipple decoration device of the present invention.

If desired arcuate pads 12 and 14 may be hingedly affixed to support arm 20 as shown in FIG. 5, the other side being identical. Herein instead of using an enlarged head portion 22 as shown in FIG. 4 a cylinder 24 is contained within a socket 26 formed on the underside 15 of arcuate pad 14. The utilization of a cylinder 24 and socket 26 will permit rotatable adjustment of arcuate pad 14 with respect to support arm 20 as shown by arrow A. It is to be understood that while identical attachments of arcuate pads 12 and 14 to support arms 18 and 20 are utilized in the preferred embodiment, it is possible to utilize different attachments on either side of the device 10 without affecting its operability.

Arcuate pads 12 and 14 are held in contact with nipple 16 by the effect of a bias force provided by spring 28. Spring 28 is contained within C-shaped, hollow, tubular member 30. As may be best seen in FIGS. 3 and 4 ends 19 and 21 of support arms 18 and 20, respectively, are in contact with spring 28. Ends 19 and 21 are shaped so that the compression of spring 28 within C-shaped, hollow, tubular member 30 will cause the support arms 18 and 20 to extend outwardly from the open ends 29 and 31 of C-shaped, hollow, tubular member 30. if desired, curved plug 32 may be attached to ends 19 and 21 of support arms 18 and 20, respectively. Curved plug 32 will act as a pad for engagement with spring 28 and also a guide for the travel of support arm 20 within hollow portion 34 of C-shaped, hollow, tubular member 30. Retaining support arms 20 within C-shaped, hollow, tubular member 30 are bent-over portions 36 and 38 formed at the ends of C-shaped, hollow, tubular member 30.

If desired spring 28 may be retained in place within C-shaped, hollow, tubular member 30 by a crimp 40 placed in C-shaped, hollow, tubular member 30.

Figure 6:
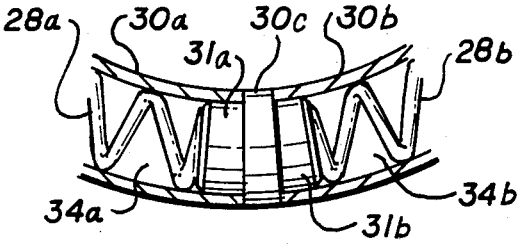
FIG. 6 is an enlarged sectional view of another alternate embodiment of the nipple decoration device of the present invention.

If crimp 40 is not desired, it is also possible to construct C-shaped, hollow, tubular member in two portions as shown in FIG. 6, specifically 30*a* and 30. The two parts, sections 30*a* and 30*b* are held together by a plug 30*c* which is specially formed with curved end portions 31*a* and 31*b* for fictional mounting of sections 30*a* and 30*b* as shown in FIG. 6. It will also be noted that when the embodiment shown in FIG. 6 is constructed it will be necessary to utilize two springs 28*a* and 28*b*, one in each hollow portion 34*a* and 34*b*, respectively.

Figure 7:
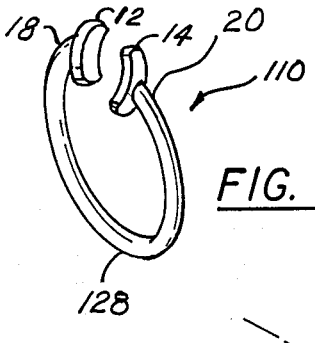
FIG. 7 is a perspective view of another alternate embodiment of the device of the present invention.
Figure 1:
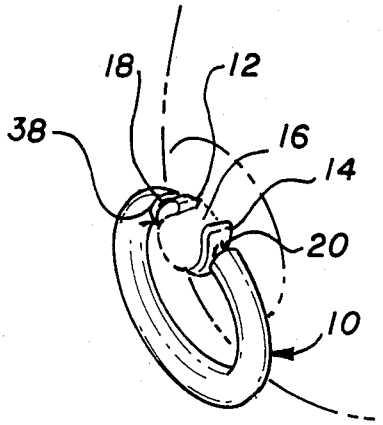
FIG. 1 is a perspective view of the nipple decoration device of the present invention mounted on a female breast.
Figure 2:
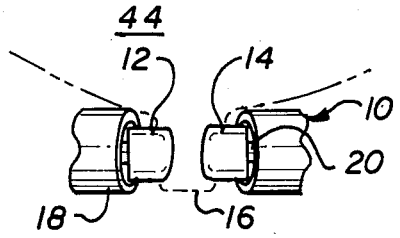
FIG. 2 is a top view of the nipple decoration device shown in FIG. 1.

As may been seen in FIG. 7 spring 28 may be replaced by an integral spring form section 128 in alternate embodiment 110. The support arms 18 and 20 as well as the arcuate pads 12 and 14 of device 110 are the same as found in the previous embodiments.

OPERATION OF THE DEVICE

The device of the present invention 10 is operated by manually compressing spring 28. As shown in FIG. 3, once spring 28 is compressed by expanding the distance between arcuate pads 12 and 14 nipple 16 may be inserted therebetween. Once in place the compressive force of spring 28 will act to move support arms 18 and 20 out of C-shaped, tubular member 30 thus causing arcuate pads 12 and 14 to be held in place on either side of nipple 16. It will be noted that spring 28 is selected so that a sufficient amount of force is present to maintain frictional contact of arcuate pads 12 and 14 with either side of nipple 16 but no so great a force as to be uncomfortable to the wearer.

When it is desired to remove nipple decoration device 10 from nipple 16 the process of putting device 10 in place is reversed. Specifically, arcuate pads 12 and 14 are spread apart thus imparting a compressive force onto spring 28 within hollow portion 34. Nipple decoration device 10 is therefore no longer in frictional contact with nipple 16 and device 10 may then be removed.

When nipple decoration device 10 has been removed arcuate pads 12 and 14 may come into contact one with another or may be held apart by the sizing of support arms 18 and 20 such that when they are in their fully extended position the contact of ends 19 and 21 with bent-over portions 36 and 38 at the end of C-shaped, tubular member 30 will hold arcuate pads 12 and 14 apart.

Device 110 is operated in essentially the same manner as device 10 however instead of compressing spring 28 as in the preferred embodiment the energy from the spreading of arcuate pads 12 and 14 is stored by the distortion of spring form section 128.

Nipple decoration device 10 may be fabricated in a number of ways. Specifically, as shown in FIGS. 3 and 4 spring 28 may be inserted within the hollow portion 34 of C-shaped, hollow tubular member 30. Support arms 18 and 20 may be placed thereon and then the ends of C-shaped, hollow, tubular portion 30 may be bent-over 36 and 38. If it is desired to hold spring 28 in place then C-shaped, hollow, tubular member 30 may itself be crimped 40 at any convenient place. If desired nipple decoration device 10 may be fabricated from a two-part C-shaped, hollow, tubular member 30*a* and 30*b* as shown in FIG. 6. This construction may be preferable if it is necessary to rotate section 30*a* with respect to 30*b* in order to properly place nipple decoration device 10 on nipple 16. Curved plug portions 31*a* and 31*b* will permit rotation of section 30*a* with respect to 30*b*.

C-shaped, tubular member 30 may be made of a variety of materials such as gold or silver. Other suitable metals normally used to fabricate jewelry may also be used to fabricate member 30. If desired a ceramic or plastic tube may be used in place of metal. Spring 28 is preferably a coil spring however any appropriate means of biasing support arms 18 and 20 may be used in place of coil spring 28. As previously noted coil spring 28 is selected to have a force which is great enough to hold nipple decoration device 10 upon nipple 16 but small enough so as to not be uncomfortable to the wearer. Support arms 18 and 20 may also be made of a metal commonly used in jewelry such as gold or silver however any other appropriate rigid material may be used. Arcuate pads 12 and 14 may be formed of either plastic or metal and if desired may be cushioned along the surface which is in contact with nipple 16. Additionally if desired arcuate pads 12 and 14 may be formed of a clear or tinted material.

Embodiment 110 may be formed from a metal or plastic material that will absorb and store a distortion force then return back to an undistorted configuration when the distortion force is released. As with the preferred embodiment 10, arcuate pads may be formed of either plastic or metal and if desired may be cushioned along the surface which is in contact with nipple 16.

While there is above disclosed several embodiments of the nipple decoration device of the present invention, it will appreciated that certain variations and modifications therein can be produced without departing from the scope of the inventive concept disclosed.

I claim:

1. A decoration device for a nipple comprising:

a substantially C-shaped, hollow, tubular member;

means for applying a bias force contained within the hollow portion of said substantially C-shaped, hollow, tubular member;

two arcuate support arms connected to said C-shape, hollow, tubular member at the ends of said member, each of said support arms having one end slidably telescopically received within the hollow portion of said substantially C-shaped, hollow, tubular member and one end protruding from said substantially C-shaped, hollow, tubular member; and two spaced apart arcuate pads, each of said two spaced apart arcuate pads being rigidly attached to the end of each arcuate support arm which protrude-from said substantially C-shaped, hollow tubular member, said spaced apart arcuate pads having concave surfaces confronting each other constructed and arranged for engagement with the sides of the nipple in generally conforming relation thereto;

whereby the decoration device will be held in place on the nipple by a bias force transmitted to said spaced apart arcuate pads by said support arms without causing undue discomfort to the wearer.

2. The decoration device of claim 1 wherein said spaced apart arcuate pads are fabricated from a plastic material.

3. The decoration device of claim 1 wherein said spaced apart arcuate pads are fabricated from metal.

4. The decoration device of claim 1 wherein said means for a applying a bias force is a coil spring.

5. The decoration device of claim 1 wherein said means for applying a bias force is mechanically fixed within said substantially C-shaped, hollow, tubular member.

6. The decoration device of claim 1 wherein said substantially C-shaped, hollow, tubular member is formed in two sections.

7. The decoration device of claim 6 wherein said means for applying a bias force is two coil springs.

8. A system for attaching a decoration device to a nipple comprising:

means for applying a bias force contained within the decoration device;

two support arms connected to said decoration device, each of said support arms having one end slidably telescopically received within the decoration device and one end protruding from the decoration device; and two spaced apart arcuate pads, each of said spaced apart arcuate pads being rigidly attached to the protruding end of a respective one of said support arms, said spaced apart arcuate pads having concave sides confronting each other constructed and arranged for engagement with the sides of the nipple in generally conforming relation thereto;

whereby the decoration device will be held in place on the nipple by said bias force transmitted to said spaced apart arcuate pads by said support arms without causing undue discomfort to the wearer.

9. The system of claim 8 wherein said each spaced apart arcuate pad is plastic.

10. The system of claim 8 wherein each spaced apart arcuate pad is metal.

11. The system of claim 8 wherein said means for applying a bias force is a coil spring.

12. The system of claim 8 wherein said means for applying a bias force is mechanically affixed within the decoration device.

13. A decoration device for a nipple comprising:

a substantially C-shaped member, said substantially C-shaped member having a central spring bias portion which extends into substantially arcuate support arms integral with and extending from either end of said spring bias portion; and two spaced apart arcuate pads, each of said two spaced apart arcuate pads being rigidly attached to the ends of said substantially arcuate support arms, said spaced apart arcuate pads having smooth continuously concave surfaces confronting each other and constructed and arranged for engagement with the sides of the nipple in generally conforming relation thereto;

whereby the decorative device will be held in place on the nipple by a bias force from said spring bias portion transmitted to said spaced apart arcuate pads by said substantially arcuate support arms without causing undue discomfort to the wearer.

* * * * *